US005838295A

United States Patent [19]

Aoyama

[11] Patent Number: 5,838,295

[45] Date of Patent: Nov. 17, 1998

[54] METHOD FOR SCROLLING IMAGES ON A SCREEN

[75] Inventor: Koji Aoyama, Hokkaido, Japan

[73] Assignee: Hudson Soft Co Ltd., Hokkaido, Japan

[21] Appl. No.: 727,284

[22] Filed: Oct. 9, 1996

Related U.S. Application Data

[63] Continuation of Ser. No. 300,071, Sep. 2, 1994, abandoned, which is a continuation of Ser. No. 940,038, Sep. 3, 1992, abandoned.

[30] Foreign Application Priority Data

Mar. 19, 1992 [JP] Japan ..... 4-093850

[51] Int. Cl.[6] ..... G09G 5/34

[52] U.S. Cl. ..... 345/124; 345/950

[58] Field of Search ..... 345/121, 122, 345/123, 124, 125, 127, 950; 395/102, 119, 125, 140, 141; 382/276, 295

[56] References Cited

U.S. PATENT DOCUMENTS

| | | | |
|---|---|---|---|
| 4,358,761 | 11/1982 | Iwasaki | 345/56 |
| 4,375,638 | 3/1983 | O'Keefe et al. | 345/174 |
| 4,404,554 | 9/1983 | Tweedy, Jr. et al. | 345/25 |
| 4,814,756 | 3/1989 | Chauvel | 340/750 |
| 4,951,038 | 8/1990 | Yamamura | 340/725 |
| 4,951,229 | 8/1990 | DiNicola et al. | 340/725 |
| 4,952,051 | 8/1990 | Lovell et al. | 352/87 |
| 4,974,173 | 11/1990 | Stefik et al. | 345/127 |
| 5,030,946 | 7/1991 | Yamamura | 340/750 |
| 5,172,102 | 12/1992 | Iwamura et al. | 345/125 |

FOREIGN PATENT DOCUMENTS

| | | | |
|---|---|---|---|
| 0399783 | 11/1990 | European Pat. Off. | 340/726 |
| 63-163891 | 7/1988 | Japan . | |

*Primary Examiner*—Amare Mengistu

*Attorney, Agent, or Firm*—Laff, Whtiesel, Conte & Saret, Ltd.

[57] ABSTRACT

A screen is divided into plural character positions each having an equal area. In at least one of the characters, characters having position-shifted patterns are displayed sequentially, so that a displayed pattern is scrolled in predetermined direction.

4 Claims, 14 Drawing Sheets

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|
| CG COLOR | | | | CHARACTER CODE | | | | | | | | | | | |

FIG. 10A

| VD8 | VD7 | VD6 | VD5 | VD4 | VD3 | VD2 | VD1 | VD0 |
|---|---|---|---|---|---|---|---|---|
| 0 | CG COLOR | | | | CH3 | CH2 | CH1 | CH0 |
| | | | | | CG1 | | CG2 | |

FIG. 10B

| VD8 | VD7 | VD6 | VD5 | VD4 | VD3 | VD2 | VD1 | VD0 |
|---|---|---|---|---|---|---|---|---|
| 1 | 0 | 0 | 0 | 0 | 0 | 0 | 0 | 0 |

CHARACTER No.1

CHARACTER No.2

CHARACTER No.3

CHARACTER No.4

CHARACTER No.1

CHARACTER No.2

CHARACTER No.3

CHARACTER No.4

METHOD FOR SCROLLING IMAGES ON A SCREEN

This application is a continuation of application Ser. No. 08/300,071, filed Sep. 2, 1994, now abandoned, which is a continuation of Ser. No. 07/940,038, filed Sep. 3, 1992, now abandoned.

FIELD OF THE INVENTION

This invention relates to a method for scrolling images on a screen, and more particularly to, a method for displaying images to be scrolled by providing viewers with a three-dimensional sense.

BACKGROUND OF THE INVENTION

In a conventional method for displaying images on a screen by use of a computer, the images are displayed by applying shadows to articles or by using the perspective representation method, so that pictures having depth are generated on the screen to provide viewers with a three-dimensional sense.

In a computer having a memory of a sufficient capacity, a number of image frames can be defined in a VRAM of the memory, so that images having depths specified to each image frame are stored, and are superimposed on the screen. In this method, a three-dimensional sense is increased by moving articles near viewers at a slow speed and articles far from viewers at a fast speed, in a case where moving images are displayed on the screen.

In a computer such as a home TV game machine having a memory of a small capacity which is decreased in cost, it is difficult to prepare a number of image frames having various depths. Such a computer has a CPU having a slow operation speed. Consequently, it is difficult for motion pictures to realize images having a three-dimensional sense.

SUMMARY OF THE INVENTION

Accordingly, it is an object of the invention to provide a method for scrolling images on a screen, in which a smooth scroll of images is realized by the unit of characters.

It is another object of the invention to provide a method for scrolling images on a screen, in which an artificial multi-scroll of images is realized even by using a memory of a small capacity.

According to the invention, a method for scrolling images on a screen, comprises;

defining a predetermined number of positions on said screen for displaying characters each having a predetermined number of dots; and displaying said characters on said positions of said screen, at least one of said characters having a displaying pattern;

wherein said displaying pattern is displayed to move in a predetermined direction in said at least one of said characters in accordance with a content of a memory, said content of said memory being stored at an address designated by one of said positions for said at least one of said characters.

BRIEF DESCRIPTION OF THE DRAWINGS

The invention will be explained in more detail in conjunction with appended drawings, wherein;

FIGS. 10A and 10B are explanatory diagrams explaining a video output of the background;

DESCRIPTION OF THE PREFERRED EMBODIMENT

Before explaining a method for scrolling images on a screen of the preferred embodiment according to the invention, the aforementioned background of the invention will be again explained.

In a computer system which is used in the invention, two kinds of image frames defined "background" and "sprite" are combined to provide one image frame, wherein the background image frame is composed of patterns defined "character". In the following explanation, the character is composed of 8×8 dots as one unit.

Figure 1:
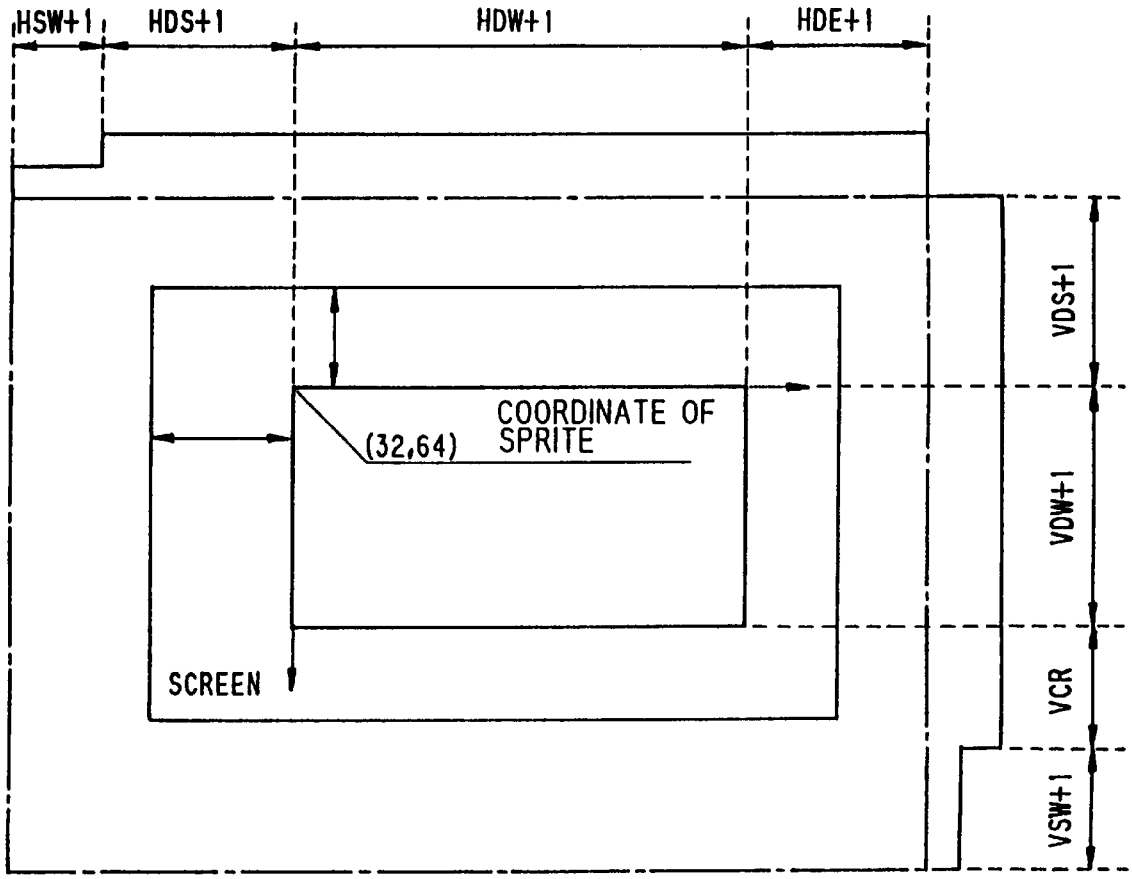
FIG. 1 is an explanatory diagram explaining a display screen.

FIG. 1 shows a display screen which is defined by values set in registers, in which the horizontal set values are defined by the number of characters, and the vertical set values are defined by the number of rasters. The registers are for HSW (horizontal sync pulse width) HDS (horizontal display start position), HDW (horizontal display width), HDE (horizontal display end position), VSW (vertical sync pulse width), VCR (vertical display end position), VDW (vertical display period), and VDS (vertical display start position).

Figure 2:
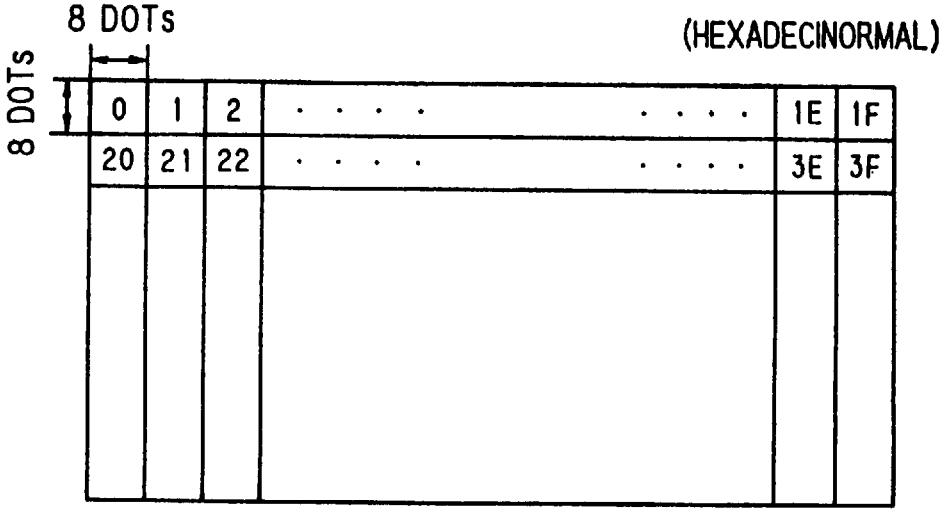
FIG. 2 is an explanatory diagram showing a virtual screen having addresses of characters in a background attribute table (BAT)

FIG. 2 shows a virtual screen which is composed of 32×32 characters, to which addresses 0, 1, 2, . . . are assigned.

Figures 3, 4:
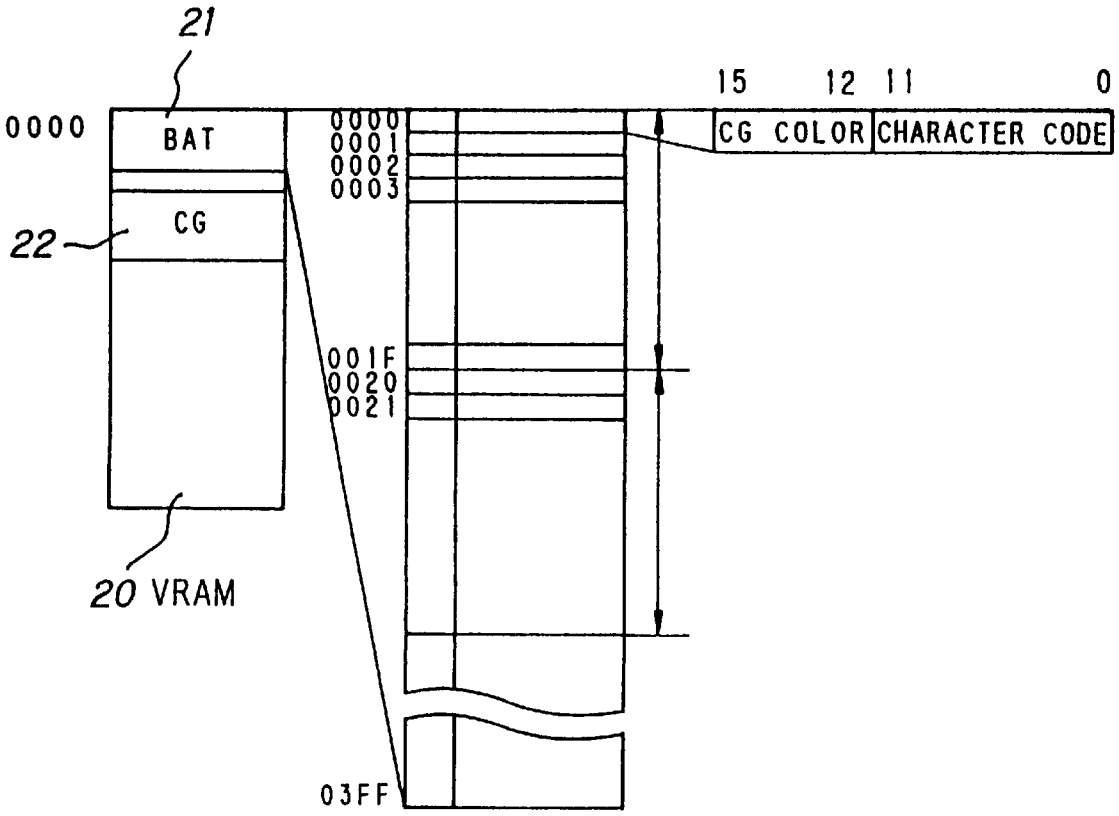
FIG. 3 is an explanatory diagram showing a position and a content of the BAT in a VRAM.
FIG. 4 is an explanatory diagram showing the BAT.

FIG. 3 shows a background attribute table (BAT) having a capacity equal to the addresses of the virtual screen which is a portion of a VRAM. The BAT stores at each address corresponding to each address of the virtual screen a set of a character code and a CG color, as explained next.

FIG. 4 shows the set of the character code (12 bits) for defining a pattern of a character, and the CG (4 bits) for defining a color.

Figure 5:
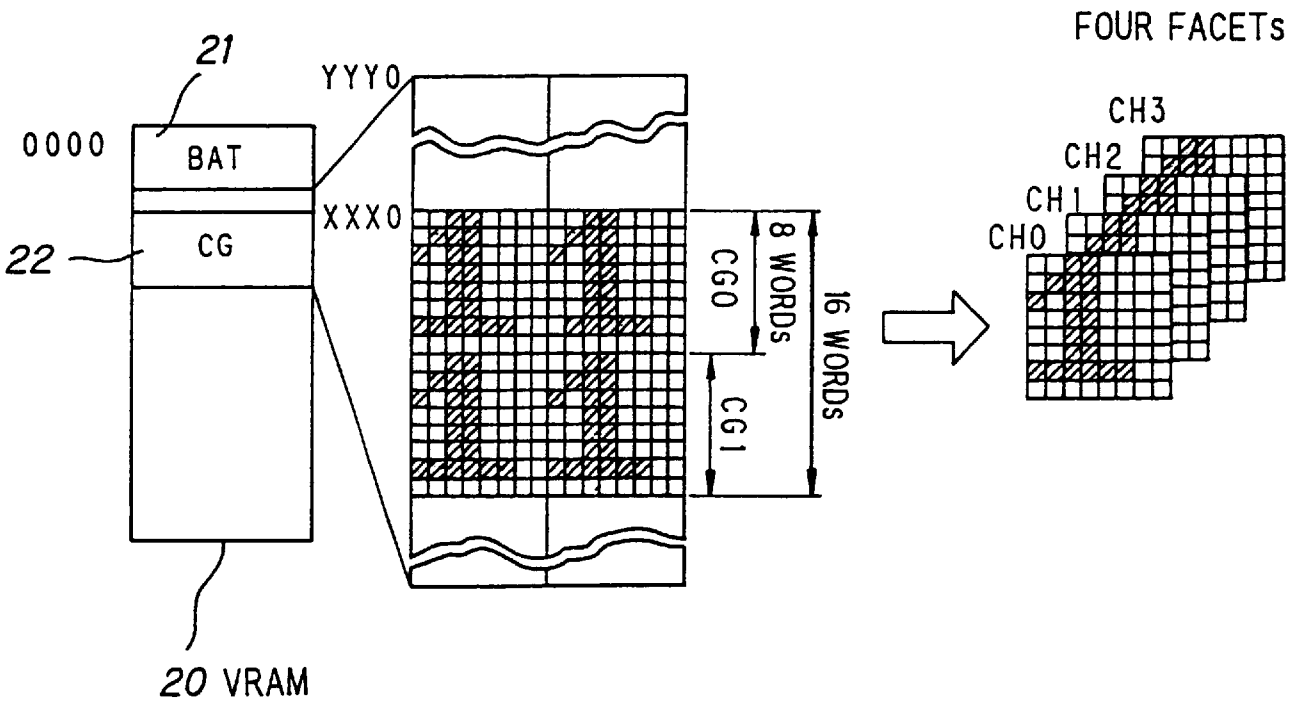
FIG. 5 is an explanatory diagram showing a position and a content of a character generator (CG) in the VRAM.

FIG. 5 shows a character generator (CG) region which is also a portion of the VRAM. The CG regions is composed of CGs each having four facets CH0, CH1, CH2 and CH3 designated in group by the character code of the BAT. The first and second facets CH0 and CH1 provide first 8 words CG0, and the third and fourth facets CH2 and CH3 provide second 8 words CG1 as shown therein.

As shown therein, each of the four facets CH0 to CH3 is composed of 8×8 dots, and is designated to provide one bit in order from 64 bits, so that a four bit signal is obtained to combined with the four bit CG color, thereby providing an address signal of 8 bits for a memory called "a color pallet".

The display control of the background is carried out in a horizontal display period, as explained below by use of FIGS. 6 to 10A and 10B.

Figure 6:
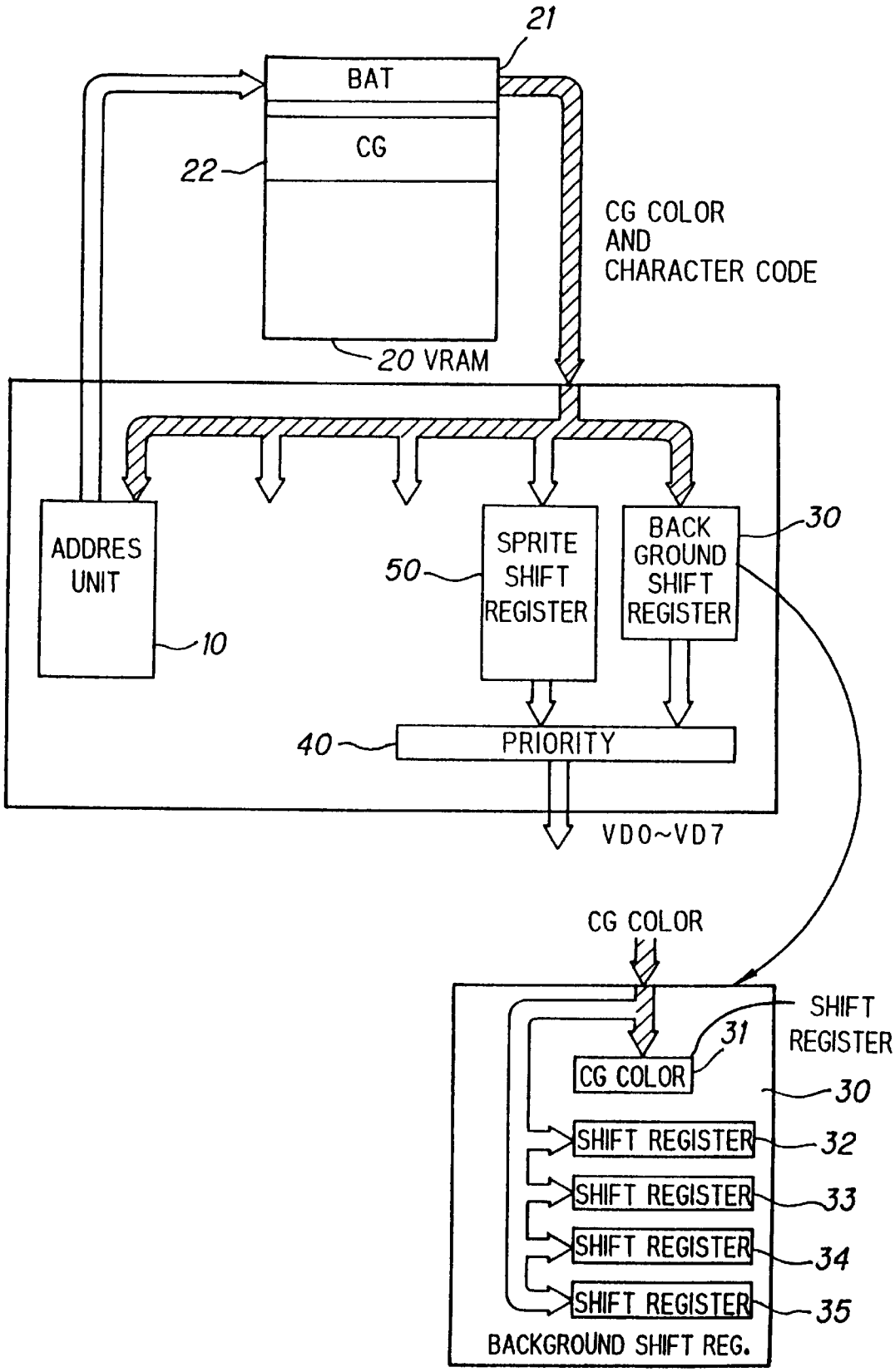
FIGS. 6 to 9 are explanatory diagrams explaining a display control of a background.

In FIG. 6, a position of a raster is detected in an address unit 10 to generate an address signal on the virtual screen as shown in FIG. 2, by which the BAT 21 of the VRAM 20 is accessed to provide a character code and a CG color as shown in FIG. 4. The character code is supplied to the address unit 10 to generate an address signal for accessing the CG region 22 of the VRAM 20, and the CG color is supplied to be stored in a CG color shift register 31 of a background shift register 30. A color pallet 41 supplies color signals.

Figure 7:
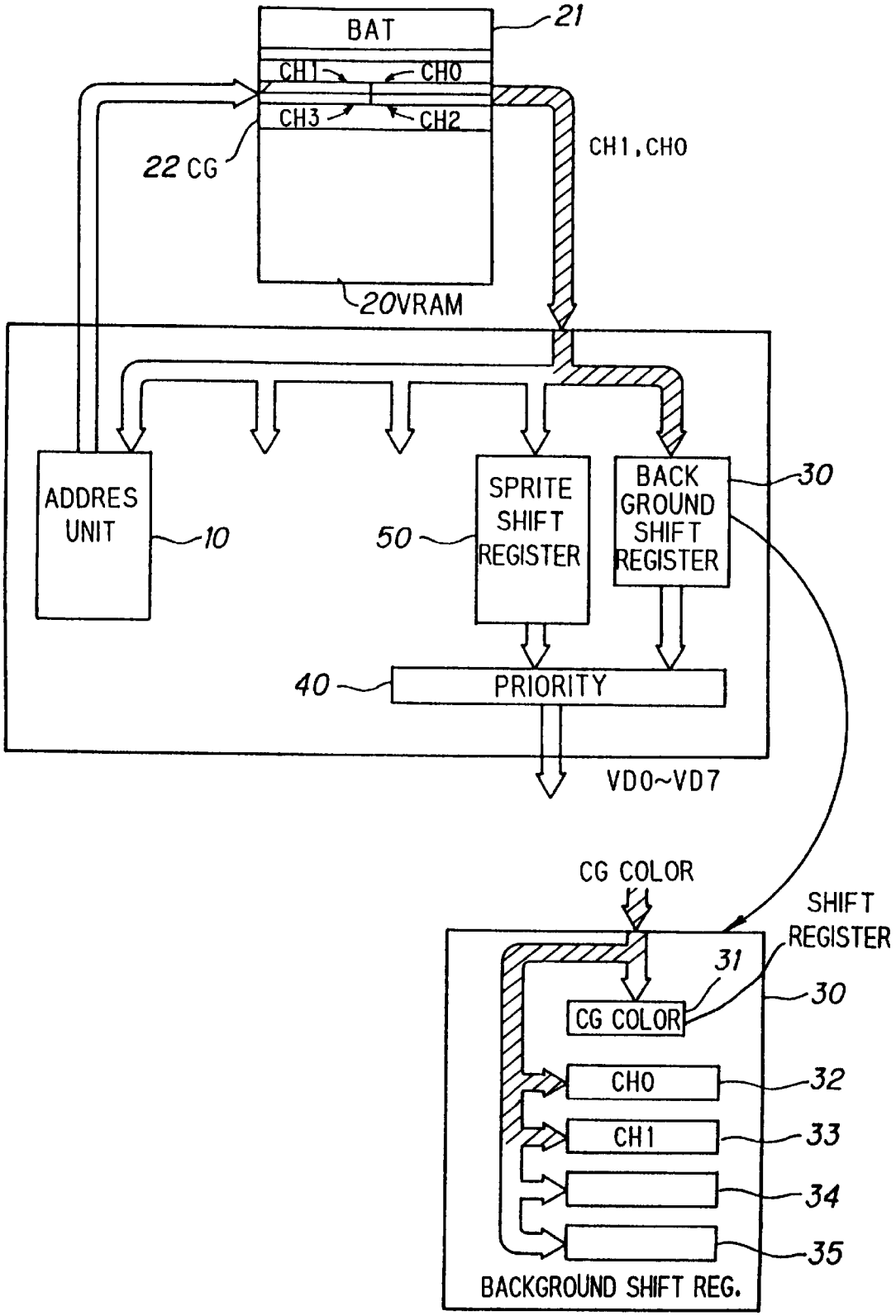

In FIG. 7, the CG region 22 is accessed by the address unit 10, so that the first two facets CH0 and CH1 are supplied to be stored in first and second shift registers 32 and 33 of the background shift register 30.

Figure 8:
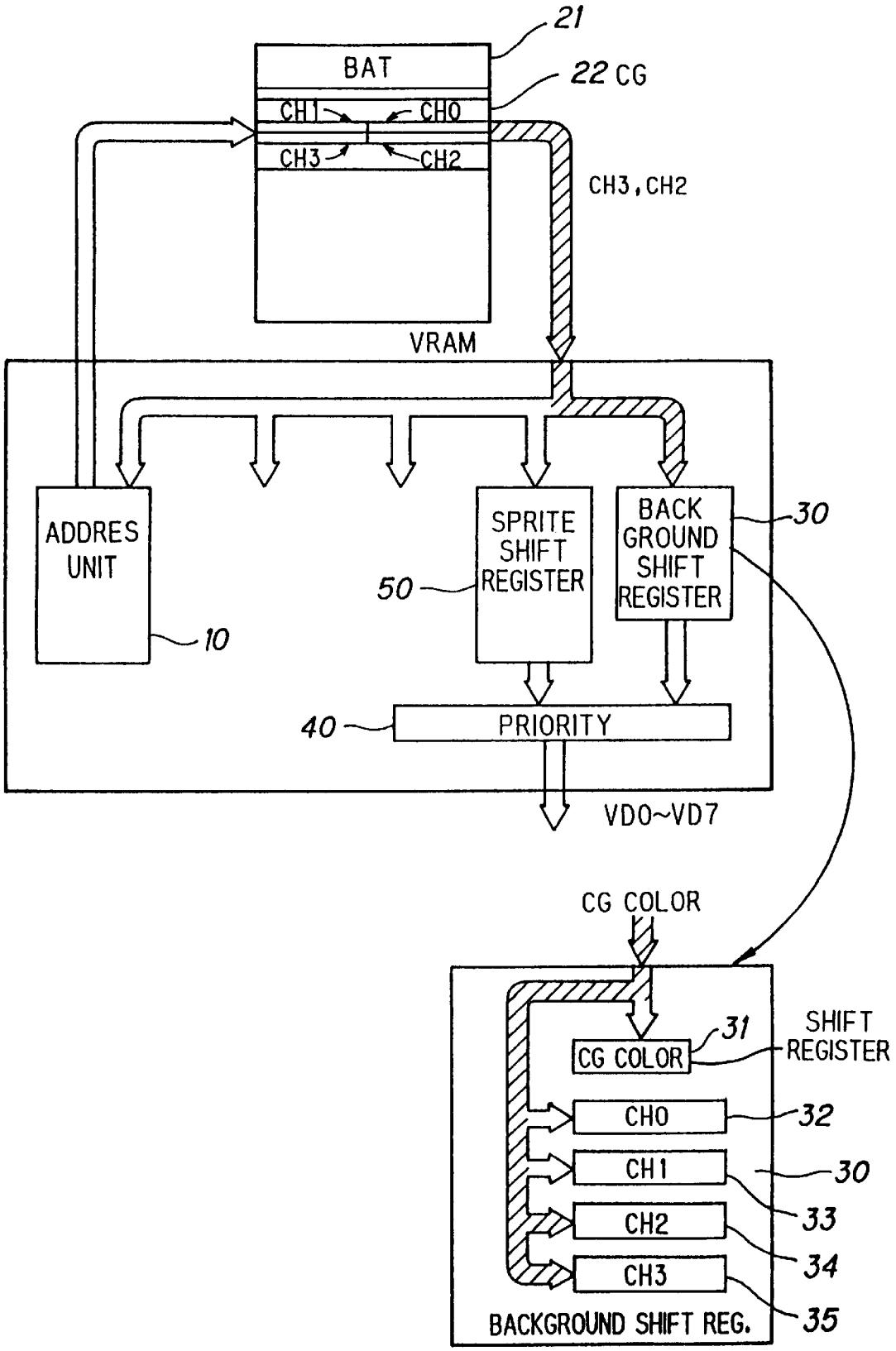

In FIG. 8, the second two facets CH2 and CH3 are read from the same address of the CG region 22 to be stored in third and fourth registers 34 and 35 of the background shift register 30.

Figure 9:
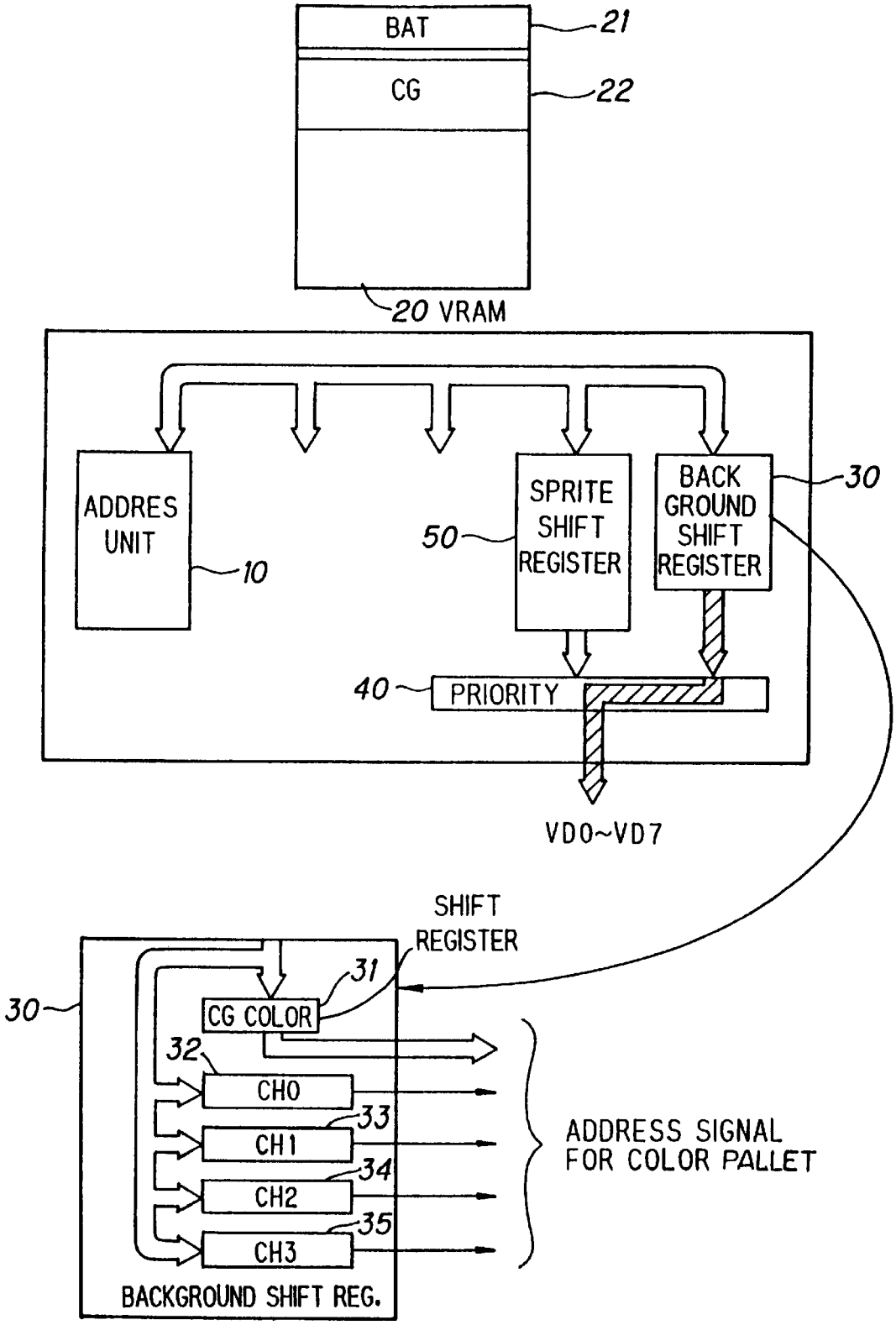

In FIG. 9, the four bit CG color is supplied from the CG color shift register 31, and one bit is supplied from each of the shift registers 32 to 35 to provide a four bit signal, so that an eight bit address signal VD0 to VD7 is generated to be supplied through a priority circuit 40 to a color pallet 41

FIG. 10A shows the eight bit address signal VD0 to VD7, to which a bit VD8 is combined, wherein the background is displayed by "0" of VD8, while a sprite is displayed by "1" of VD8.

FIG. 10B shows a display output during a period of retrace, in which the bit VD8 is "1", and the bits VD0 to VD7 are "0". For the display of sprites, a sprite shift register 50 is used to store sprite data.

In a display as described above, vertical and horizontal smooth scrolling are carried out by use of registers called BGY and BGX scroll registers (not shown), in which scroll data are stored. The vertical scroll can be performed by a unit of rasters, and the horizontal scroll can be performed by a unit of dots. In the vertical scroll based on the unit of rasters, a scroll can not be carried out character by character. On the other hand, a horizontal scroll can be done character by character, because the horizontal scroll is carried out dot by dot.

In this case, however, a method of a raster interruption must be adopted. As a result, the setting of a timing becomes difficult. This is one of disadvantages which is overcome by the invention.

Next, a method for scrolling images on a screen of the preferred embodiment according to the invention will be explained in FIGS. 11A to 11D.

Figure 11A:
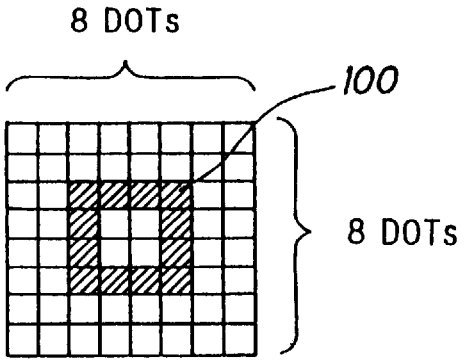
FIGS. 11A to 11D are explanatory diagrams showing square character patterns in a method for scrolling images on a screen, in which a vertical scroll is realized, in a preferred embodiment according to the invention.
Figure 11B:
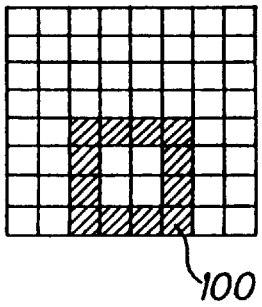
Figure 11C:
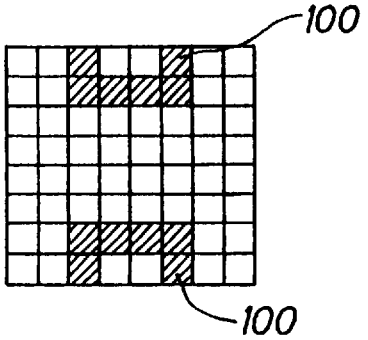
Figure 11D:
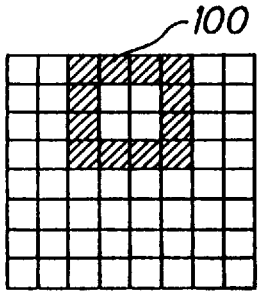
Figure 12A:
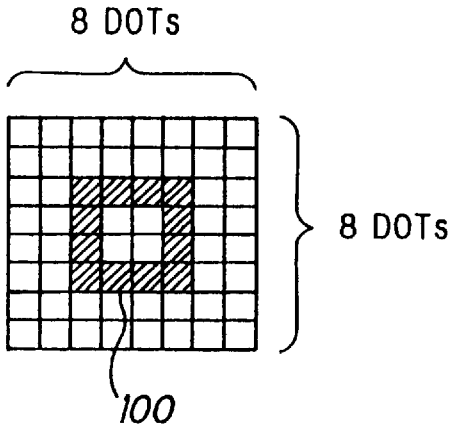
FIGS. 12A to 12D are explanatory diagrams showing square character patters in a method for scrolling images on a screen, in which an inclination scroll is realized, in the preferred embodiment.
Figure 12B:
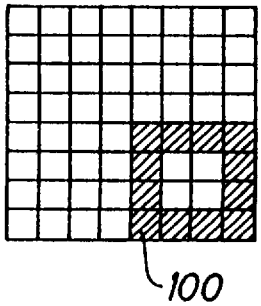
Figure 12C:
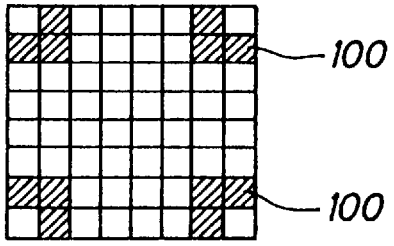
Figure 12D:
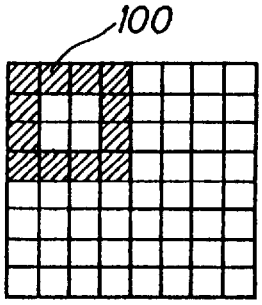

FIG. 11A shows a character pattern No. 1 of 8×8 dots having a squarely closed belt shape 100 (simply defined "mark" hereinafter), and FIGS. 11B to 11D show character patterns No. 2 to No. 4 of the same size having marks 100, each position of which is shifted in the vertical direction by two dots.

In operation, the character patterns No. 1 to No. 4 are in order displayed at an addressed position(s) selected from the addresses 0, 1, 2, of the virtual screen (FIG. 2) in accordance with the process using the BAT 21 and the CG region 22 of the VRAM 20, the background shift register 30, the color pallet, etc. as explained before, so that the vertically scrolling display of the mark is carried out at the selected address position on the screen, wherein the mark moves downwardly. On the other hand, the mark moves in the upper direction, in case where the character patterns are displayed in the order of No. 4 to No. 1.

This scroll is carried out by a program stored in a ROM (not shown), and is defined "artificial scroll" which is discriminated from a smooth scroll which is carried out by a system (hardware).

The smooth scroll must be carried out on a whole plane of the screen, while the artificial scroll can be carried out on a limited portion of the screen and on different portions thereof by using character patterns having different marks.

The artificial scroll using the different marks is defined "artificial multiple scroll", in which scrolls may be carried out in any direction such as vertical, horizontal, and inclination directions by using character patterns having predetermined shifted marks.

In realizing an inclination scroll by using the smooth scroll, vertical and horizontal scrolls must be combined. However, it can be carried out directly by using the artificial multiple scroll of the invention.

FIGS. 12A to 12D shows character patterns No. 1 to No. 4 of 8×8 dots having marks 100, by which the inclination scroll can be carried out. The mark moves in the upper left to lower right direction by displaying the character patterns in the order of No. 1 to No. 4, while the marks moves in the lower right to upper left direction by displaying them in the order of No. 4 to No. 1.

Figures 13A, 13B:
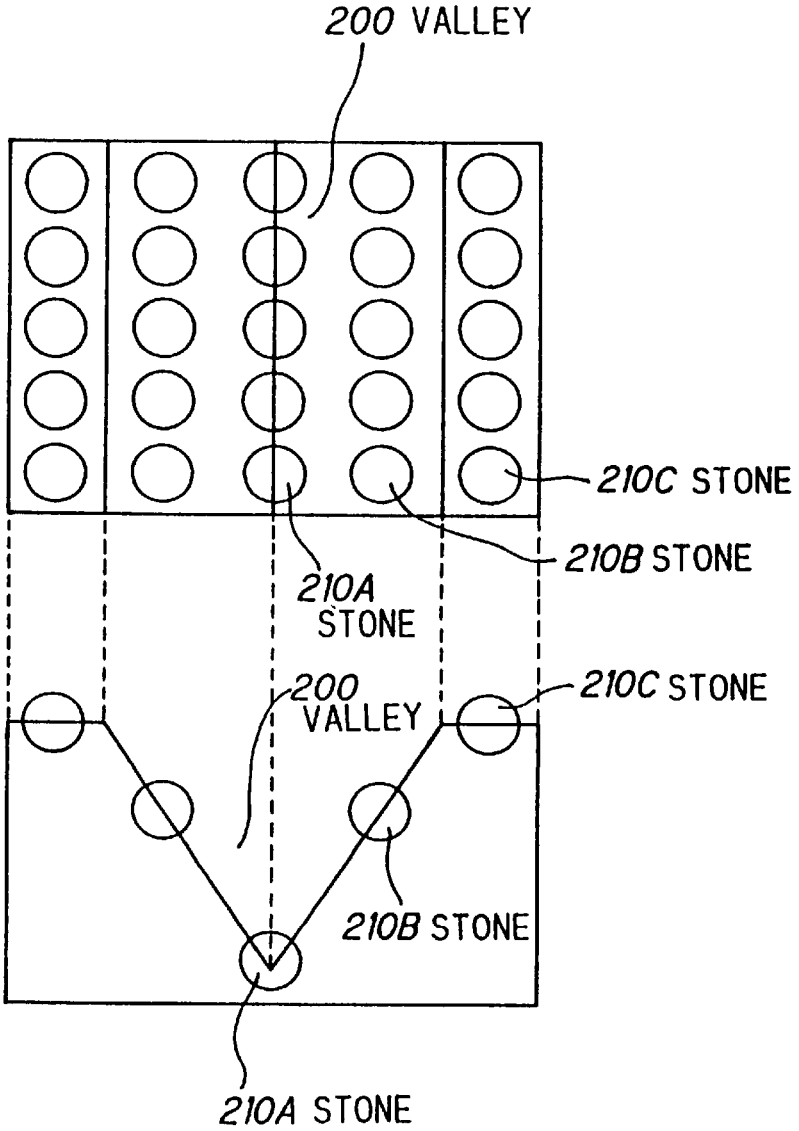
FIGS. 13A and 13B are plan and side views explaining displays of a valley in the preferred embodiment.

FIGS. 13A and 13B shows a display of a valley 200 of V shape having stones 210A on the bottom and 210B and 210C on the outside. A plurality of characters display large and small sizes in order to provide a perspective representation in a display pattern. Also, in order to provide viewers with a three-dimensional sense on this display, the bottom stones 210A are controlled to move slowly as compared to the outside stones 210B and 210C, if it is assumed that the viewers look down the valley 200 from an airplane. In addition, the stones 210A are preferably displayed to be smaller as compared to the outside stones 210B and 210C.

Figure 14A:
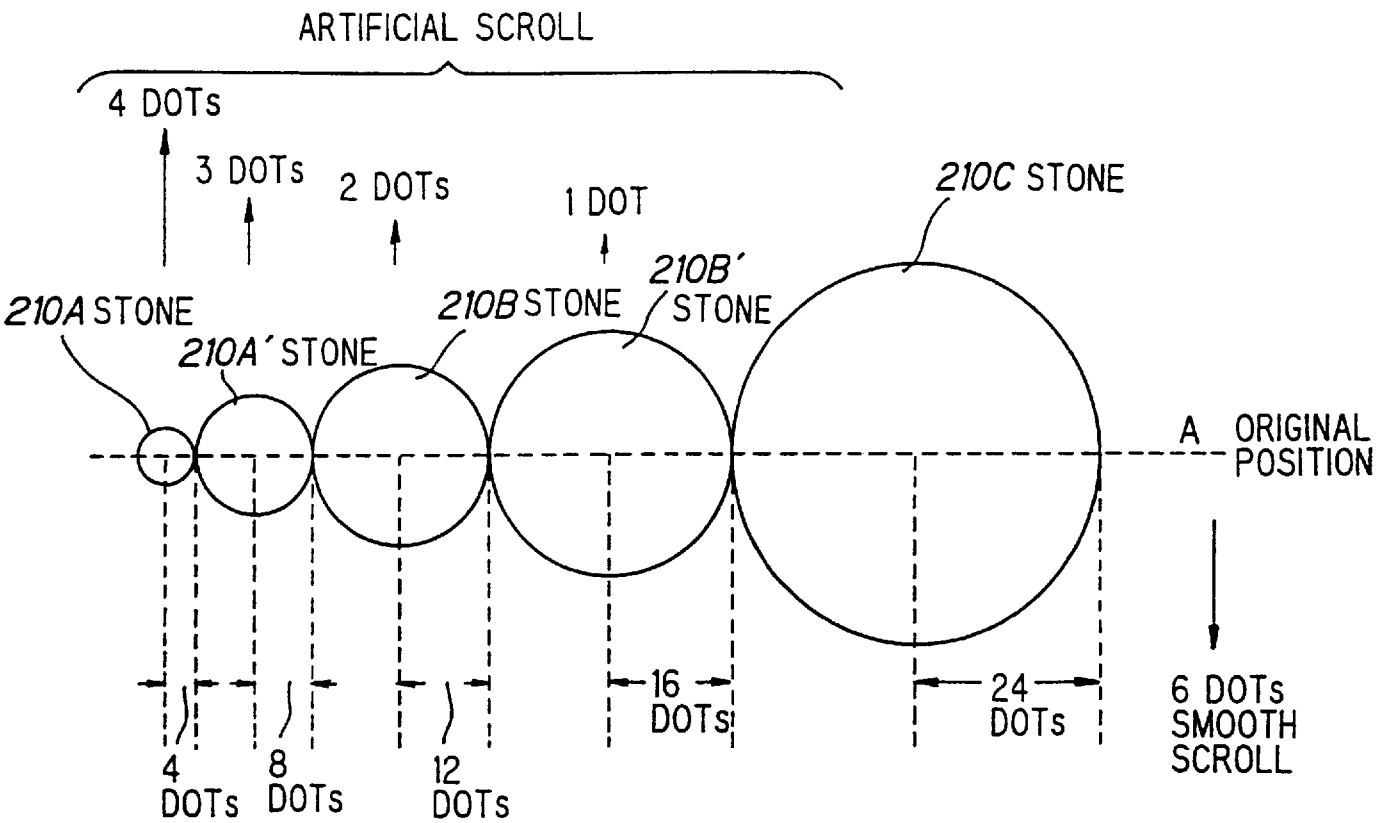
FIGS. 14A and 14B are explanatory diagrams explaining superimposing of a smooth scroll and an artificial multi-scroll in the preferred embodiment.

FIG. 14A shows the bottom and outside stones 210A, 210A', 210B, 210B' and 210C displayed on a right half portion of the screen having a dotted line A for an original position in accordance with the method as explained in FIGS. 13A and 13B. As understood from the illustration in FIG. 14A, the bottom stone 210A occupies one character (8×8 dots), and the stones 210A', 210B, 210B' and 210C occupy 4 characters, 9 characters, 16 characters, and 36 characters in terms of area. That is, the stones 210A to 210C occupy 16 characters in the horizontal direction on the right half portion of the screen. In the vertical direction, a predetermined number of the bottom stones 210A are arranged to contact with upper and lower ones. Other stones 210A' to 210C are arranged in the vertical direction in the same manner as those 210A.

In this assumption, the vertical smooth scroll is carried out in the lower direction in accordance with a rate of 6 dots during a period of 1V which is a unit of the detection number in a vertical retrace period. In this preferred embodiment, the period of 1V is 1/60 sec. In addition to the vertical smooth scroll, the artificial multiple scroll is applied to the display of the valley in accordance with the invention. That is, four dots artificial vertical scroll is carried out for the bottom stones 210A, three dot artificial vertical scroll for the stones 210A', two dot artificial vertical scroll for the stones 210B, one dot artificial vertical scroll for the stones 210B', and no artificial vertical scroll for the stones 210C, respectively, in the upper direction, as shown in FIG. 14A by arrows.

The resultant scroll values are obtained in a below table.

| STONES | SMOOTH SCROLL | ARTIFICIAL SCROLL | RESULTANT SCROLL |
|---|---|---|---|
| 210A | +6 | −4 | +2 |
| 210A' | +6 | −3 | +3 |
| 210B | +6 | −2 | +4 |
| 210B' | +6 | −1 | +5 |
| 210C | +6 | 0 | +6 |

Figure 14B:
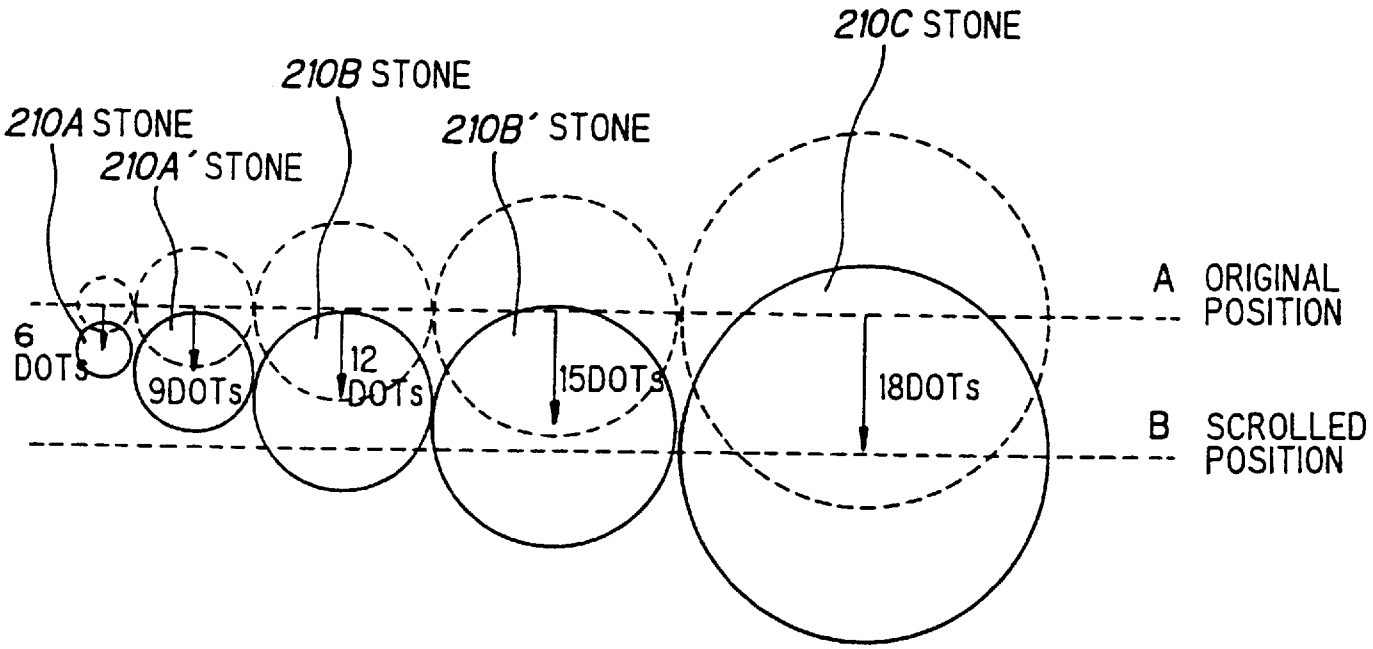

In accordance with the resultant vertical scroll, the stones 210A to 210C moves downwardly by dots as shown in FIG. 14B, when a time has been elapsed by 3V(=3/60 sec). In FIG. 14, the dot amounts are indicated by three times of the resultant scroll values. Consequently, the display of the valley provides viewers with cubic sense having the depth and power of images.

In accordance with a smooth scroll conducted by a system, an operation is required to comply with an algorithm of the system.

On the other hand, an artificial multiple scroll of the invention is carried out by a user program, so that the flexibility is obtained in operation.

As explained in the preferred embodiment, a vertical scroll can be carried out character by character. This has a significant meaning in accordance with the combination of the vertical smooth scroll which is carried out raster by raster.

Consequently, there is a significant advantage in providing motion pictures having the depth.

In an ordinary display of a background, characters of a small number in kind are used to decrease a capacity of a memory. The artificial multiple scroll of the invention complies with the requirement of suppressing a memory capacity in a home TV game system.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A method for scrolling images on a screen, comprising;

displaying background images on a screen, defining a predetermined number of sprite positions on said screen for displaying movable sprite characters against said background, each of said characters being formed by a predetermined number of dots;

displaying said characters at said positions on said screen, at least one of said characters having a displaying pattern;

means wherein said displaying pattern enables the sprite to move in substantially any selected predetermined direction for said at least one of said characters in accordance with information stored in a memory, said information being stored in said memory at addresses designated by said positioned on said screen for displaying said at least one of said characters;

said at least one of said characters comprising a plurality of characters extending from a small to a large display of patterns which are selected and displayed to provide small and large size patterns in accordance with perspective representation and depth perception in order to provide apparent three dimensional images of said characters as they appear to move toward or away from the viewer.

2. A method for scrolling images on a screen, according to claim 1, wherein said addresses are stored in a background attribute table in a video random access memory;

said information being stored in a character generator region in said video random access memory; and said displaying pattern displayed by colors designated in a color pallet by said stored information, said displaying pattern moving in response to changing one of said addresses and said information.

3. A method for scrolling images on a screen, according to claim 1, wherein said characters displayed on said positions of said screen are combined to make a smooth scroll in said substantially any direction which is carried out under control of a computer system program.

4. A method of scrolling images on a screen defined by a plurality of image locations which are identified by individually associated screen addresses, means for storing image information identifying at least one character in a memory at a plurality of different memory locations which are individually identified by said screen addresses, said one character having a common image pattern including color information at each of said plurality of memory locations, means for scrolling said one character to move in any direction across said screen by reading out said different memory locations in an order selected to correspond to the desired scrolled movement of said one character on said screen directly and in a shortest direction to a selected one of said locations, a first memory means storing first data relating to color and second data relating to a character pattern, a second character generation memory means storing positioned signals in the form of data according to said second data, means responsive to said first data and said position signals for providing a signal combining colored data in a character pattern at a desired position, said second data representing patterns having a plurality of graduated sizes, and depth perception means for selecting sizes which are smaller in one area and larger in another area in order to provide a three dimensional depth perspective effect in said character image as it appears to move toward or away from the viewer.

* * * * *